US010975605B2

(12) United States Patent
Hamilton et al.

(10) Patent No.: US 10,975,605 B2
(45) Date of Patent: Apr. 13, 2021

(54) LIFTING APPARATUS FOR A FLEXIBLE DIVIDER

(71) Applicant: Seaway Plastics Ltd., Lachine (CA)

(72) Inventors: Rodney Hamilton, Beaconsfield (CA); Joey Madden, Lachine (CA)

(73) Assignee: Seaway Plastics Ltd., Quebec (CA)

( * ) Notice: Subject to any disclaimer, the term of this patent is extended or adjusted under 35 U.S.C. 154(b) by 339 days.

(21) Appl. No.: 15/980,410

(22) Filed: May 15, 2018

(65) Prior Publication Data

US 2018/0340362 A1 Nov. 29, 2018

Related U.S. Application Data

(60) Provisional application No. 62/512,124, filed on May 29, 2017.

(51) Int. Cl.

| | |
|---|---|
| ***E05F 15/686*** | (2015.01) |
| ***E05F 15/60*** | (2015.01) |
| ***E05D 15/26*** | (2006.01) |
| ***E05D 15/22*** | (2006.01) |
| ***E06B 9/00*** | (2006.01) |
| *E06B 9/06* | (2006.01) |
| *E04B 2/74* | (2006.01) |

(Continued)

(52) U.S. Cl.

CPC ..... *E05F 15/60* (2015.01); *E05D 15/22* (2013.01); *E05D 15/262* (2013.01); *E05F 15/686* (2015.01); *E06B 9/00* (2013.01); *E04B 2/74* (2013.01); *E05F 1/02* (2013.01); *E05F 1/08* (2013.01); *E05Y 2900/136* (2013.01); *E05Y 2900/142* (2013.01); *E06B 9/0692* (2013.01)

(58) Field of Classification Search

CPC . E05F 15/686; E05F 1/02; E05F 1/046; E05F 15/60; E05D 15/22; E05D 15/262; A47H 5/00; A47H 5/02; A47H 5/032; A47H 5/14; A47H 11/06; E06B 9/00; E06B 9/0692; E06B 9/262; E06B 2009/2622; E06B 9/06; E06B 3/01; E04B 2/74; A01K 1/007; A63J 1/02

USPC ..... 160/84.01, 84.02, 84.04, 84.07

See application file for complete search history.

(56) References Cited

U.S. PATENT DOCUMENTS 3,416,672 A * 12/1968 Kohaut ..... A47H 5/14 211/103

4,090,692 A * 5/1978 Jacobs ..... B66D 3/06 472/78

(Continued)

*Primary Examiner* — Johnnie A. Shablack

*Assistant Examiner* — Jeremy C Ramsey

(74) *Attorney, Agent, or Firm* — McDonnell Boehnen Hulbert & Berghoff LLP

(57) ABSTRACT

A lifting apparatus is provided. The lifting apparatus includes a lifting cable supported relative to the ceiling structure, the lifting cable extending along a vertical direction and attaching to a lift point on the flexible divider. The lifting cable is retractable in the vertical direction to lift the flexible divider from a lowered configuration to a raised configuration. The lifting apparatus further includes a guiding element for guiding a position of the lifting cable along a horizontal direction while the flexible divider moves between the lowered configuration and the raised configuration. The guiding element is movably mounted to the ceiling structure to move between a first horizontal position when the flexible divider is in the lowered configuration, and a second horizontal position when the flexible divider is in the raised configuration.

21 Claims, 13 Drawing Sheets

(51) Int. Cl.
*E05F 1/02* (2006.01)
*E05F 1/08* (2006.01)

(56) References Cited

U.S. PATENT DOCUMENTS 4,606,527 A * 8/1986 Ziller ..... A63J 1/028
254/336
6,662,847 B1 * 12/2003 Squibb ..... E06B 9/0692
160/84.01

* cited by examiner

LIFTING APPARATUS FOR A FLEXIBLE DIVIDER

CROSS REFERENCE TO RELATED APPLICATIONS

The present application claims priority from U.S. provisional application No. 62/512,124 filed on May 29, 2017, the entirety of which is incorporated herein by reference.

TECHNICAL FIELD

The present disclosure relates to lifting apparatuses, for example to lift flexible dividers such as walls, curtains, etc. which are generally used to enclose spaces and/or divide spaces into smaller sections.

BACKGROUND

Products exist for dividing large spaces that have a non-parallel ceiling to floor profile. These divider walls can partially or completely fill the vertical space from floor to ceiling. When lowered, they split the existing space into smaller sections, and when stored in the raised position, they match the ceiling profile and restore the space to full size.

Current products available for this application use either excessive fullness that matches the dimension of the ceiling profile, or they use angular lift cables so that the rising divider meets the ceiling profile at a narrower width (lift cables are normally vertical). These solutions are less than ideal, as they create excessive stresses on the materials and lift systems and also permanently distort the divider wall materials.

Most manufacturers install a standard space divider wall used for parallel ceiling to floor profiles, even when the ceiling to floor profile is non-parallel, due to the lack of current solutions for the change in geometry. This can limit the divider wall and/or not allow the divider wall to be raised above the lowest point of the non-parallel ceiling. However, this situation is unacceptable for many facilities, since these structures are often designed to provide higher clearance when the space is not divided. In these cases, the manufacturer will specify and supply multiple smaller divider walls to increase the final opening height when the many divider walls are stored in the raised position, which still may not provide full potential clearance.

SUMMARY

According to an aspect, a lifting apparatus for lifting a flexible divider in a space having a ceiling structure is provided. The lifting apparatus includes: a lifting cable supported relative to the ceiling structure, the lifting cable extending along a vertical direction and attaching to a lift point on the flexible divider, said lifting cable being retractable in the vertical direction to lift the flexible divider from a lowered configuration to a raised configuration; and a guiding element for guiding a position of the lifting cable along a horizontal direction while the flexible divider moves between the lowered configuration and the raised configuration, said guiding element being movably mounted to the ceiling structure to move between a first horizontal position when the flexible divider is in the lowered configuration, and a second horizontal position when the flexible divider is in the raised configuration.

According to an aspect, a lifting apparatus for lifting a flexible divider in a space having a ceiling structure is provided. The lifting apparatus includes: a plurality of lifting cables supported relative to the ceiling structure, the plurality of lifting cables extending along a vertical direction and attaching to corresponding lift points spaced apart along a width of the flexible divider, the plurality of lifting cables being retractable in the vertical direction to lift the flexible divider from a lowered configuration to a raised configuration; and a plurality of guiding elements, each of the plurality of guiding elements being configured to guide a corresponding one of the plurality of lifting cables along a horizontal direction while the flexible divider moves between the lowered configuration and the raised configuration, said plurality of guiding elements being movably mounted to the ceiling structure to move along corresponding horizontal travel distances when the flexible divider moves between the lowered configuration and the raised configuration.

According to an aspect, a method of lifting a flexible divider to a raised configuration conforming to a contour of a segment of a ceiling structure is provided. The method includes the steps of: retracting lifting cables attached to corresponding lift points on the flexible divider in a vertical direction towards the ceiling structure, thereby moving the flexible divider from a lowered configuration towards the raised configuration; and while the flexible divider is moving towards the raised configuration, displacing the lifting cables in a horizontal direction towards a peak of the segment of the roof structure.

According to an aspect, a lifting apparatus is provided. The lifting apparatus includes: a flexible divider wall; a guiding structure attached to the ceiling having a shape corresponding to a profile of the ceiling; pulleys attached laterally along the guiding structure; guiding elements travelling along the guiding structure, the guiding elements can travel between a first position when the flexible divider wall is lowered and a second position when the flexible divider wall is lifted; lifting cables having first ends that are pullable to lift the flexible divider wall via the pulleys and second ends respectively attached to lift points on the flexible divider wall, each of the lifting cables being respectively guided by the corresponding guiding element; and a biasing device operatively connected to at least one of the guiding elements, the biasing device urging the guiding elements toward their respective first positions, the guiding elements being urged to their respective second positions when the flexible divider wall is lifted by means of the lifting cables.

DETAILED DESCRIPTION

Figure 1:
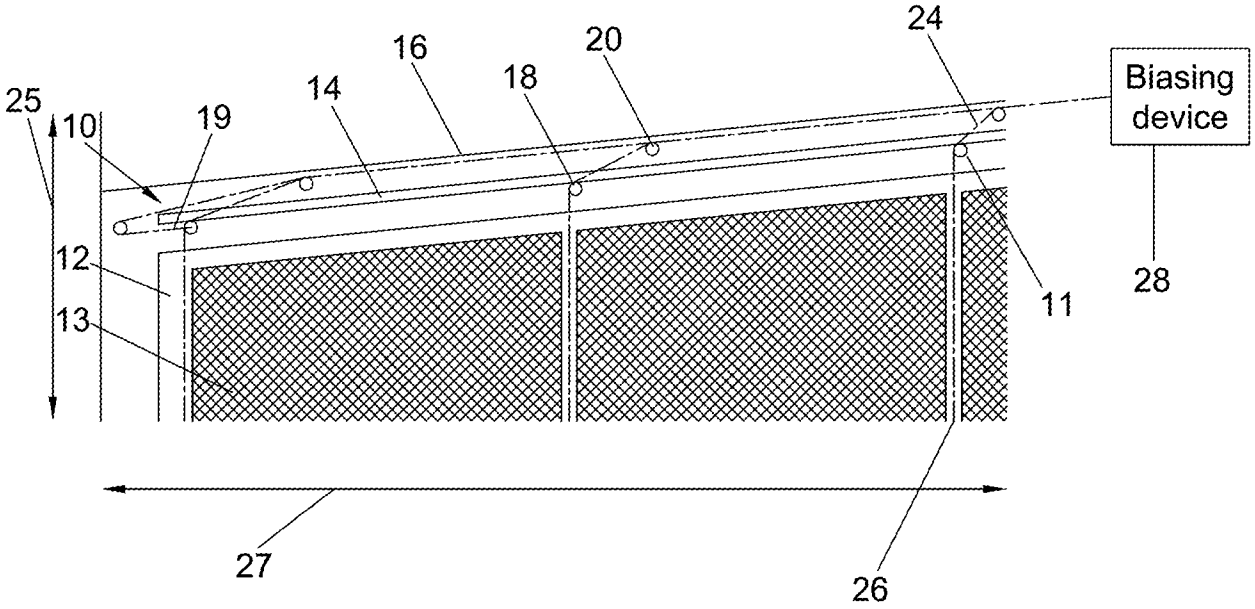
FIG. 1 is a front partial view of a lifting apparatus in an environment in accordance with an embodiment where guiding elements are urged toward a first position.
Figure 2:
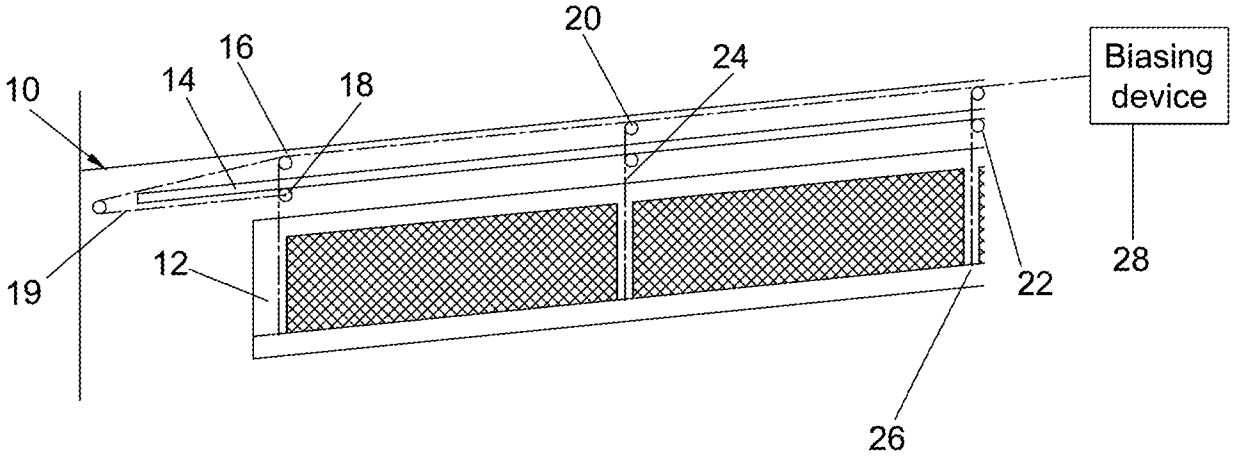
FIG. 2 is a front partial view of the apparatus described in FIG. 1 in accordance with an embodiment where guiding elements are urged toward a second position.

Referring to FIG. 1 and FIG. 2, there is shown a lifting apparatus 10 for lifting a flexible divider 12 in accordance with an embodiment. In FIG. 1 the configuration of the components of the apparatus 10 are shown while the flexible divider 12 is in a lowered configuration, while in FIG. 2 the configuration of the components of the apparatus 10 are shown while the flexible divider 12 is lifted towards a raised configuration.

In the illustrated embodiment, the flexible divider 12 is a divider wall, for example to divide a large space such as a gymnasium. However, it is appreciated that the lifting apparatus can be used in combination with other types of flexible dividers as well, such as curtains, partitions, etc., for example to partition, divide, separate, enclose, or decorate a space, among other functions. In the present embodiment, the flexible divider 12 comprises a net/mesh 13 which can be coated or uncoated materials, however it is appreciated that the divider 12 can comprise other materials as well, such as single or double-layered vinyl, woven or non-woven scrim (for example made from polyester), etc., which can be coated or uncoated. In some embodiments, the flexible divider 12 can comprise several sections made from different combinations of the materials described above.

In the illustrated configuration, the flexible divider 12 is provided to divide a space having a ceiling structure 16. As can be appreciated, the ceiling structure 16 can be any structure extending over the space. For example, in some embodiments, the ceiling structure 16 can comprise a structure defining a roof covering the space, and/or can comprise a structure helping to support said roof or covering. In other embodiments, the ceiling structure 16 can comprise structures extending from the ceiling or roof. In yet further embodiments, the ceiling structure 16 can comprise free-standing structures and/or support structures provided inside a building, for example to support or suspend elements such as light fixtures, ventilation, audio-visual equipment, personnel access/walkways, etc. above the ground. For example, the ceiling structure 16 can comprise structural elements such as trusses, joists, beams, frames, rafters, girders, arches, domes, cables, etc., for example made of steel, timber, concrete, or other available building materials. In some embodiments, the ceiling structure 16 can comprise a structure specifically designed to support a divider, wall, curtain, or the like.

As shown in FIG. 1 and FIG. 2, lifting cables 24 are provided to raise and/or lower the flexible divider 12. Although the term lifting "cables" is used herein, it is appreciated that such elements can correspond to any drive element capable of performing similar functions when cooperating with winches, pulleys, or the like. In the present embodiment, the lifting cables 24 are supported relative to the ceiling structure 16 and extend at least partially along a vertical direction 25. The lifting cables 24 have a first end that is operatively connected to a pulling or retracting mechanism (for example such as a motor or a manual winding mechanism or winch), and a second end that is attached to corresponding lift points 26 on the flexible divider 12. The lifting cables 24 can be retracted or tensioned along the vertical direction 25 to lift the flexible divider 12 from a lowered configuration (as shown in FIG. 1) towards a raised configuration (as shown in FIG. 2). As can be appreciated, while a pulling force exerted on the lifting cables 24 can raise the flexible divider 12, the lifting cables 24 can be released or relaxed along the vertical direction 25 to allow the flexible divider 12 to drop and return to the lowered configuration. In the present embodiment, the lifting cables 24 comprise lifting cables which can be made of wire, steel cable, and/or other similar types of material. It is appreciated, however, that drive elements can comprise rope, webbing, chain, belts, and/or type of elements suitable for lifting/pulling, and/or any combination thereof.

In the presently illustrated embodiment, the lifting cables 24 are supported relative to the ceiling structure 16 via fixed pulleys 20. The fixed pulleys 20 are attached to the ceiling structure 16 via fasteners such as, but not limited to, screws, nails or bolts. In other embodiments, the fixed pulleys 20 can be integral parts of the ceiling structure 16 or can be attached to, or form part of, other structural elements to be supported relative to the ceiling structure 16. In the present embodiment, the fixed pulleys 20 change a direction of the lifting cables 24 and allow a segment thereof to extend and move along the vertical direction 25. More specifically, in the present embodiment, an upstream segment of lifting cables 24 proximate the first end extends substantially along a horizontal direction 27. Upon wrapping around fixed pulleys 20, a downstream segment of lifting cables 24 proximate the second ends extends substantially along the vertical direction 25. In this configuration, lifting cables 24 can be retracted substantially along the horizontal direction 27, for example via a pulling or retracting mechanism, and the horizontal lifting force will be converted to a vertical lifting force via pulleys 20 to allow the flexible divider 12 to be raised along the vertical direction 25, towards pulleys 20. The pulleys 20 can comprise, for example, yoyo drums, drums, roller, bearings, etc. It is appreciated that other configurations of pulleys are possible to transfer lifting force as required. In some embodiments, the fixed pulleys 20 can redirect cables 24 such that their upstream segments can be driven by a common pulling or retracting mechanism, whereas their downstream segments can attach to different spaced-apart lift points 26 on the flexible divider 12. It is appreciated that in some embodiments, fixed pulleys 20 can drive lifting cables 24 directly. For example, the fixed pulleys 20 can be motorized, and can each individually control/wind a corresponding lifting cable 24 directly along the vertical direction 25.

Guiding elements 18 are provided to guide lifting cables 24 while the flexible divider 12 is being raised and/or lowered. In the present embodiment, the guiding elements 18 comprise mobile pulleys positioned between the first and second ends of the lifting cables 24, and more specifically between the second end of the lifting cables 24 and the fixed pulleys 20. The guiding elements are configured to guide a position of the liftings cables 24 along the horizontal direction 27, although it is appreciated that other types of guiding elements are possible. In the present embodiment, the guiding elements 18 are movably supported relative to the ceiling structure 16 to move between a first position 11 when the flexible divider 12 is in the lowered configuration (as shown in FIG. 1), and a second position 22 when the flexible divider 12 is in the raised configuration (as shown in FIG. 2). In this configuration, as the guiding elements 18 move, the vertically-extending segments of lifting cables 24 are translated along the horizontal direction 27. For example, in the presently illustrated embodiment, when the flexible divider 12 is in the lowered configuration, the guiding elements 18 can be in a first position 11 horizontally spaced apart from the fixed pulleys 20, whereas when the flexible divider 12 is lifted towards the raised configuration, the guiding elements 18 can move along the horizontal direction 27 towards the fixed pulleys 20. In some embodiments, in the second position 22, the guiding elements 18 can be substantially vertically aligned with the fixed pulleys. It is appreciated that other configurations are possible.

In the present embodiment, the lifting apparatus 10 comprises a guiding structure 14 for guiding corresponding guiding elements 18. The guiding structure 14 comprises one or more guiding members attached to the ceiling structure 16 using fastening means such as screws, nails, bolts or the like. The guiding members can be configured to engage with the guiding elements 18 and constrain motion thereof along a defined path. For example, the guiding members can comprise one or more tracks in which the guiding elements 18 can engage and slide along. In some embodiments, the guiding elements 18 can engage in a single track, whereas in other embodiments, the guiding elements 18 can engage in two or more tracks, such as in two or more parallel and/or adjacent tracks, for example to provide more stability. Although in the present embodiment guiding structure 14 comprises a member secured to ceiling structure 16 it is appreciated that in other embodiments guiding structure 14 can be an integral part of ceiling structure 16. Moreover, the guiding member has been described as a track, it is appreciated that different types of structural elements and/or guiding mechanisms can be used to guide the guiding elements 18.

Figure 10:
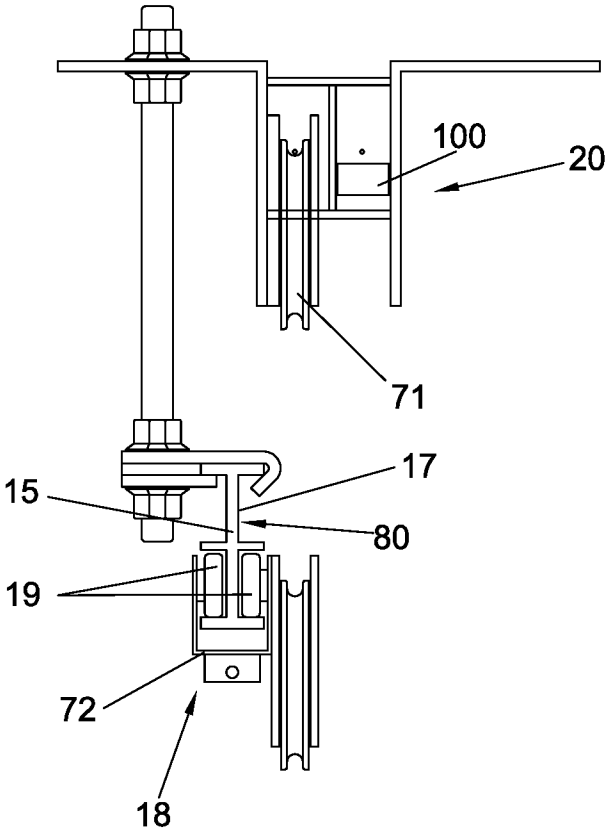
FIG. 10 is a profile view of a cable guide and a mobile lift pulley in accordance with an embodiment.

With reference to FIG. 10, a detailed view of guiding structure 14 and guiding elements 18 is shown according to an embodiment. In this embodiment, guiding structure 14 comprises a track member 15 with corresponding slots 17 for engaging with guiding element 18. Guiding element 18 comprises a body with a pulley and engagement elements 19 for engaging in slots 17 of track member 15 and allowing the body of guiding element 18 to move there along. In the illustrated embodiment, engagement elements 19 comprise wheels engaging in opposite slots/tracks 17 in track member 15 and bearing thereon, allowing the guiding element 18 to move along track member 15 with relatively little friction or resistance. It is appreciated that other engagement elements 19 are possible, for example including bearing elements such as a sled to allow guiding element 18 to slide along the track member 15.

Figure 3:
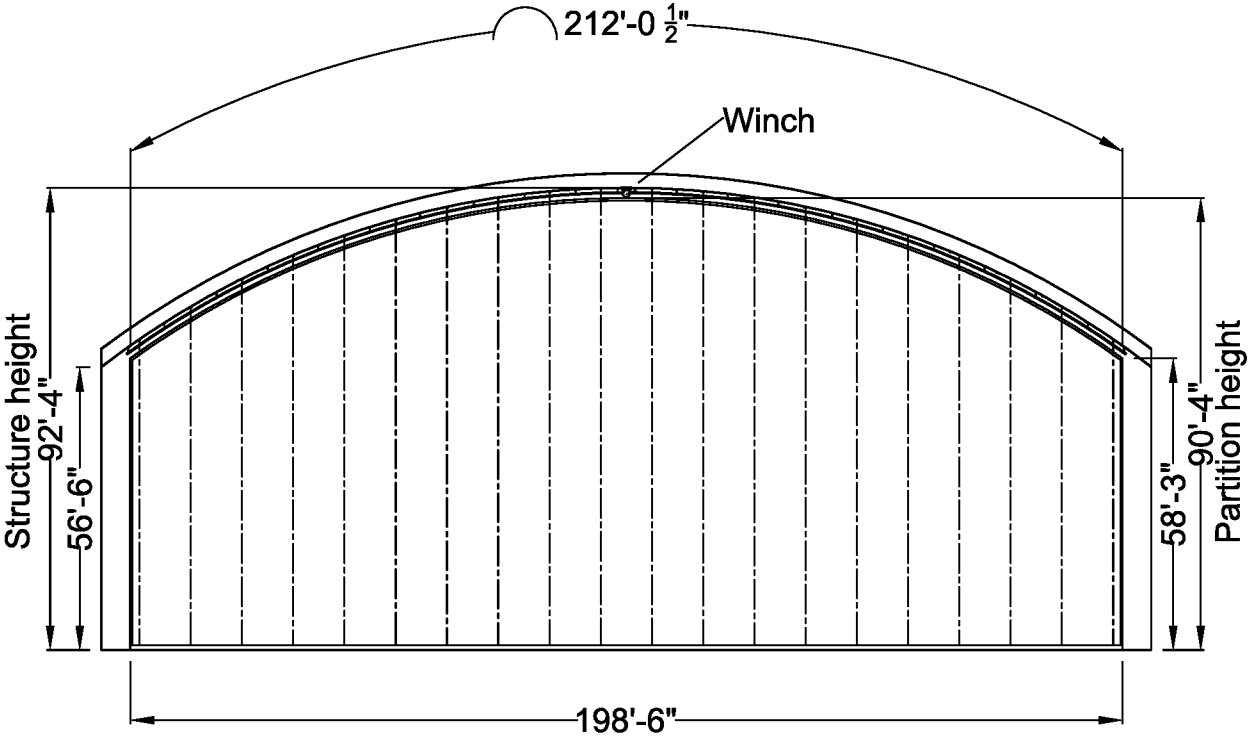
FIG. 3 is a front view of a lifting apparatus in accordance with an embodiment with a ceiling having an arch profile, where a flexible divider wall is being lowered.
Figure 4:
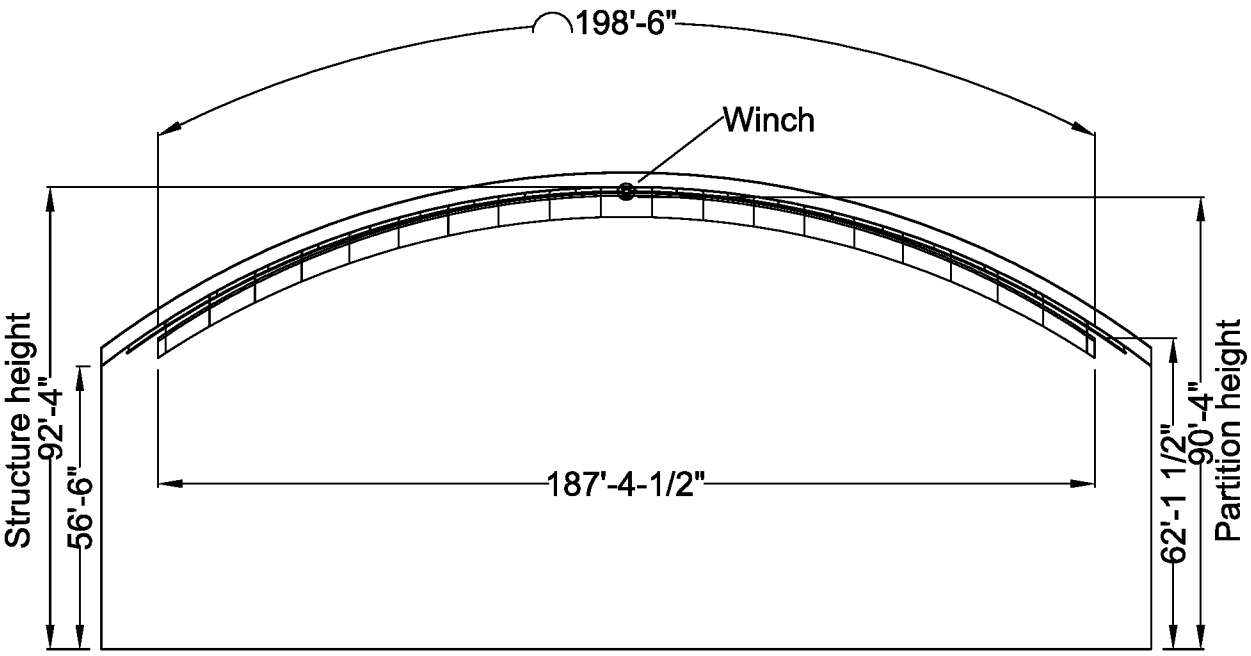
FIG. 4 is a front view of the lifting apparatus of FIG. 3, where the flexible divider wall is being lifted.
Figure 5:
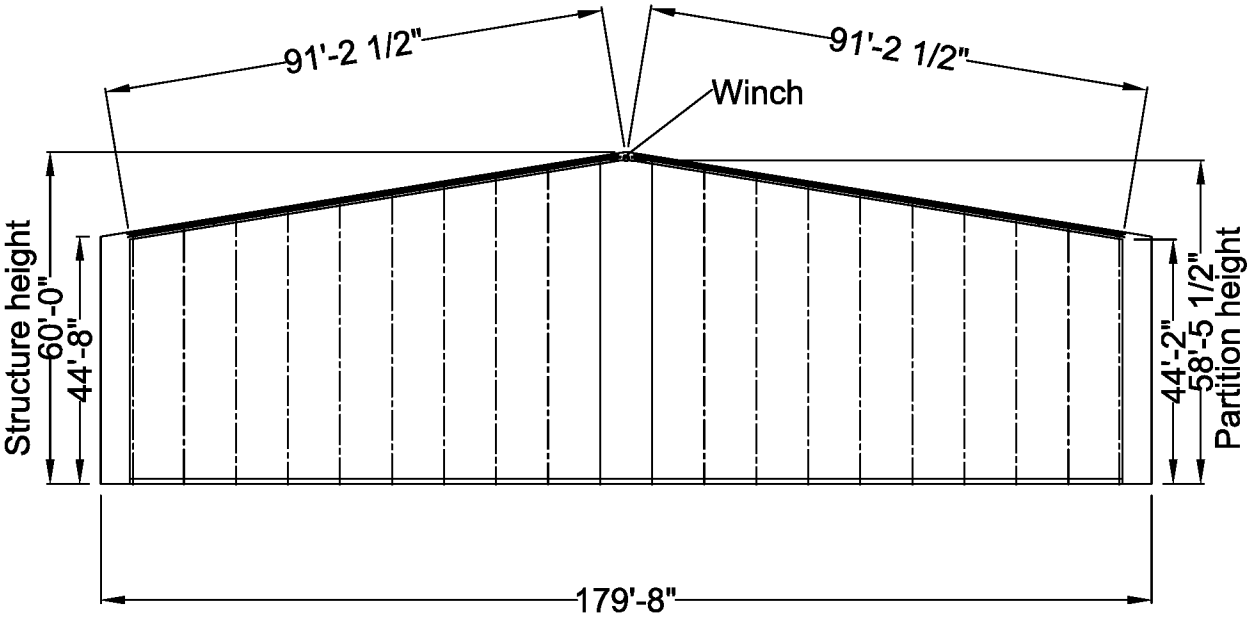
FIG. 5 is a front view of a lifting apparatus in accordance with an embodiment with a ceiling having a peak profile, where a flexible divider wall is being lowered.
Figure 6:
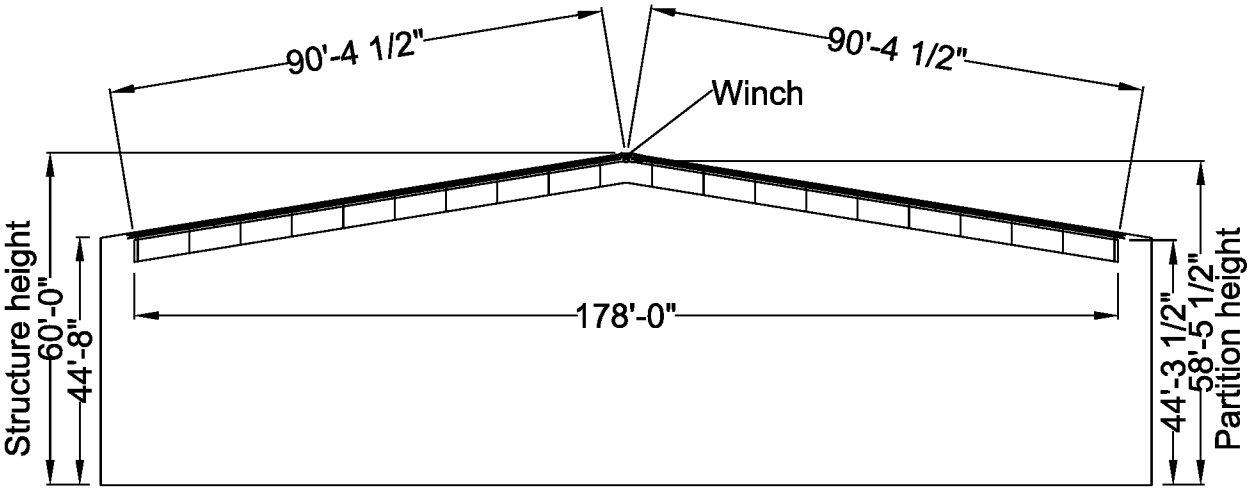
FIG. 6 is a front view of the lifting apparatus of FIG. 5, where the flexible divider wall is being lifted.
Figure 7:
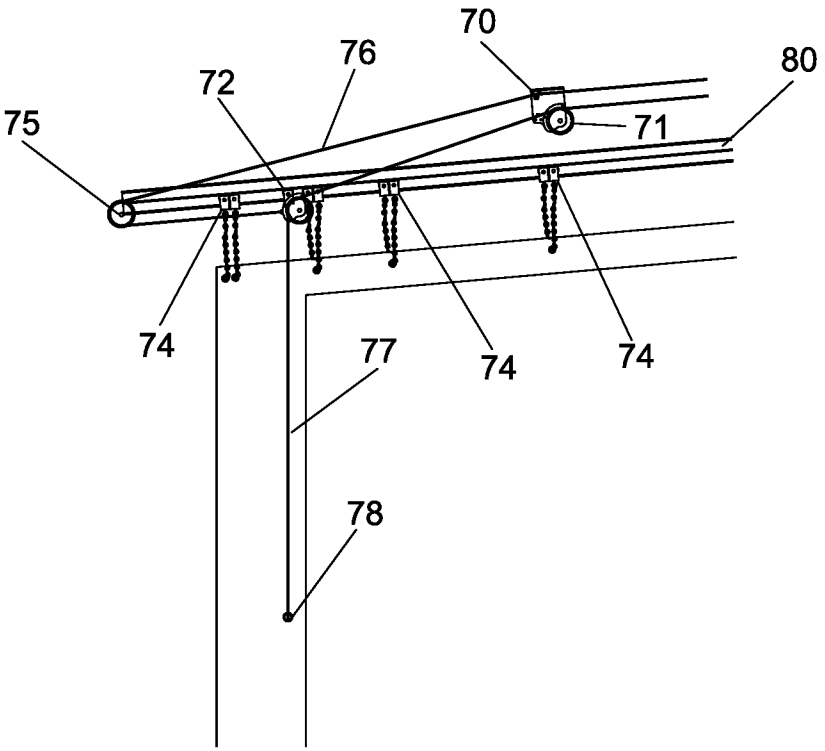
FIG. 7 is a front partial view a lifting apparatus in accordance with an embodiment with a control cable, where guiding elements are urged toward a first position.
Figure 8:
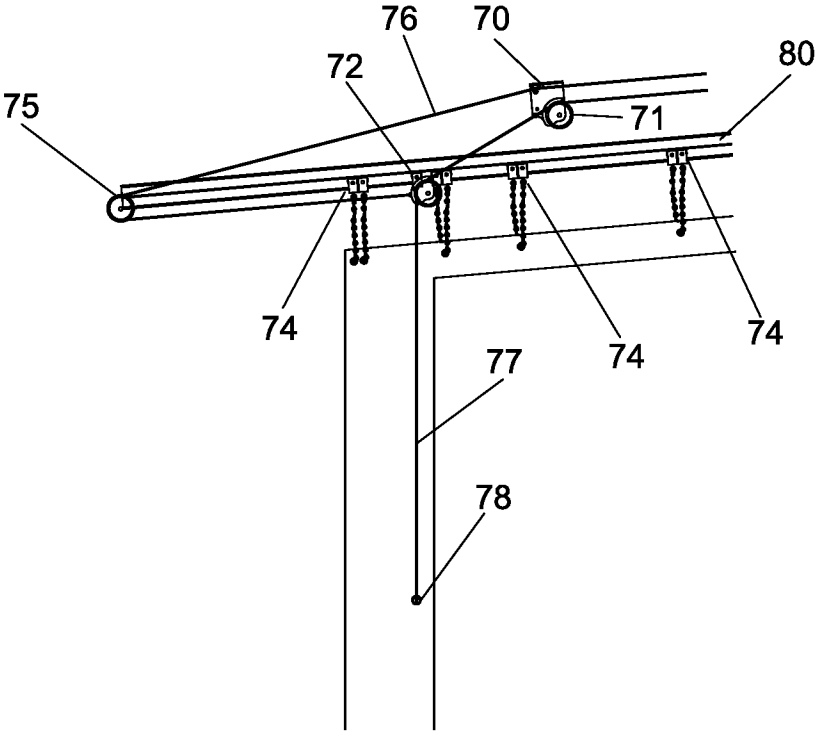
FIG. 8 is a front partial view of the lifting apparatus of FIG. 7, where guiding elements are positioned between the first position and a second position.
Figure 9:
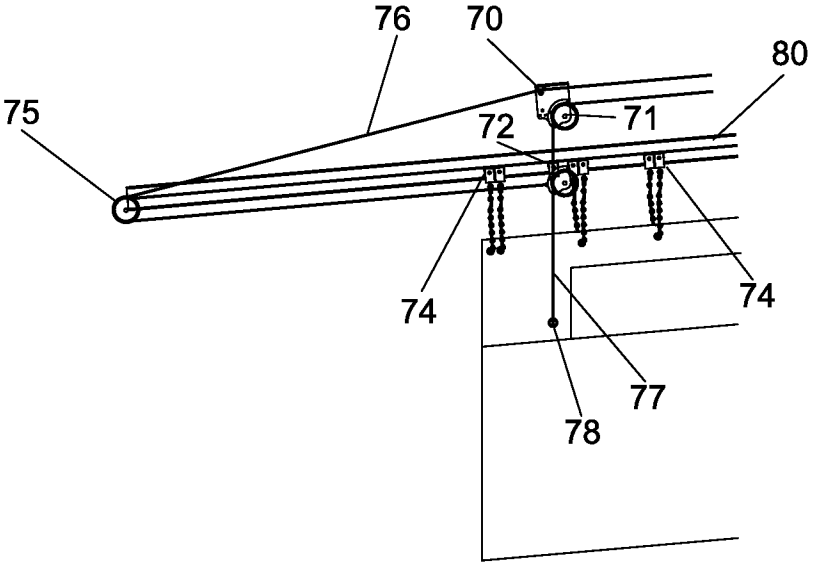
FIG. 9 is a front partial view of the lifting apparatus of FIG. 7, where guiding elements are urged toward the second position.

As can be appreciated, depending on the configuration of the space in which the flexible divider 12 is installed, the ceiling structure 16 may not be parallel to the ground or floor. For example, the ceiling structure 16 can be sloped relative to the ground, and/or can have a convex or concave shaped profile such as an arch (as shown in FIG. 3 and FIG. 4), a peak (as shown in FIG. 5 and FIG. 6), an inverted peak, or other shapes. In such embodiments, the guiding structure 14 can have a shape corresponding to the profile of the ceiling structure 16, including, but not limited to, the shape of a slope, a peak, an inverted peak or an arch. In such configurations, the shape of the guiding structure 14 can comprise a peak (i.e. a highest point of the guiding structure 14 relative to the floor) and one or more ridges (i.e. a lowest point of the guiding structure 14 relative to the floor). In some embodiments, the guiding structure 14 can comprise one or more sequentially arranged segments, such as track segments, along which guiding elements 18 can travel, with said sequentially arranged segments following the contour of ceiling structure 16. In some embodiments the guiding structure 14 can be formed using straight segments, curved segments, and/or combinations thereof. The successive arrangement of segments can allow the shape of the guiding structure 14 to match the profile of the ceiling structure 16, allowing guiding elements 18 to follow a profile of ceiling structure 16 as they move. In some embodiments, the guiding structure 14 can define an axis having a slope along which guiding elements can travel 18. In some embodiments, the lifting apparatus 10 can be configured such that guiding elements 18 move horizontally away from the ridges of guiding structure 14 towards the peak as the flexible divider 12 is raised.

As can be further appreciated, in spaces where the ceiling structure 16 is not parallel to the ground, the flexible divider 12 can further have a shape which corresponds to the profile of the ceiling structure 16 such that it can fully divide the space between the ground and the ceiling structure 16. In such embodiments, a top section or edge of the flexible divider can have a contour substantially conforming to the contour of the ceiling structure, while a bottom section or edge of the flexible divider can have a contour which is substantially rectilinear and parallel to the ground. In such an embodiment, a perimeter of the bottom contour or edge can be different than a perimeter of the top contour or edge of the flexible divider 12 and different than a perimeter of the contour of the ceiling structure 16. The lifting apparatus 10 described above can allow alleviating tension in such a flexible divider 12 while it is raised and allow it to neatly conform to the contour of the ceiling structure 16 (or a segment thereof) when the flexible divider 12 is raised. In operation, the lifting cables 24 can be retracted along the vertical direction 25 to lift the flexible divider 12 via the lift points 26 proximate to the bottom edge of flexible divider, thus lifting the bottom edge of the flexible divider 12 towards the top edge. While the flexible divider is being raised, the lifting cables 24 can be displaced along the horizontal direction 27 via the guiding elements 18, for example in an inward direction towards the peak. Once the bottom edge of the flexible divider 12 reaches its final position near the top edge, the lifting cables 24 can be horizontally positioned such that the corresponding lifting points 26 adjacent the bottom edge of the flexible divider 12 are positioned to allow the bottom edge of the flexible divider 12 to be supported while following a contour of a segment of the ceiling structure 16 without being significantly stressed or tensioned. As can be appreciated, in the configuration of lifting apparatus 10 described above, as the lifting cables 24 are retracted, the tension in lifting cables 24 can apply a force to guiding elements 18 causing them to move inwards towards their second position 22. Similarly, as lifting cables 24 are released, gravity can allow guiding elements 18 to move outwards and back towards their first position 11. In some embodiments, however, a control assembly can be provided to more directly control a displacement of the guiding elements 18, for example to control a rate of horizontal displacement of the lifting cables 24 as the flexible divider 12 is raised to assure that it folds neatly.

In the embodiment shown in FIG. 1 and FIG. 2, the control assembly comprises a biasing device 28 operatively connected to at least one of the guiding elements 18. The biasing device 28 can comprise different biasing elements to actively or passively control the movement of guiding elements 18, including a counterweight, a spring, or a motor, among others. As shown in FIG. 1, the biasing device 28 urges the guiding elements 18 toward their respective first positions 11 when the flexible divider 12 is being lowered. Conversely, when the flexible divider 12 is being lifted by means of the lifting cables 24 the guiding elements 18 are urged to their respective second positions 22 as a result of the action of the biasing device 28. It is appreciated that in some embodiments, the biasing device 28 can apply a force in only one direction, for example to resist or oppose the force applied by lifting cables 24 on the guiding elements 18. In other embodiments, the biasing device 28 can be operated to alternately apply a force in two opposite directions.

In the illustrated embodiment, a control cable 19 is provided for operatively coupling the biasing device 28 to the at least one guiding element 18. The control cable 19 has a first end attached to the at least one guiding element 18 and a second end operatively coupled to a biasing element such as a counterweight, a spring or a motor. In some embodiments, the biasing device 28 can comprise at least one linear actuator attached to the control cable. It is appreciated, however, that in other embodiments, the biasing device 28 can be operatively connected directly to guiding element 18 without a cable, or that other connection means can be provided. In yet further embodiments, the control assembly can comprise an actuator or a motor configured to drive a movement of the at least one guiding element 18 in at least two opposite directions.

In the embodiment illustrated in FIG. 1 and FIG. 2, the biasing device 28 is operatively connected to an outermost one of the guiding elements 18. The guiding elements 18 are mechanically linked together via the lifting cables 24 and the flexible divider wall 12, thereby allowing a biasing force applied to outermost guiding element to be transferred to the remaining guiding elements 18 when the flexible divider 12 is raised and/or lowered. It is appreciated that in other embodiments, further connections can be provided to transfer biasing force from one guiding element 18 to another. It is further appreciated that in some embodiments, two or more guiding elements 18 can be biased via a common biasing device 28 or via separate biasing devices.

Examples

In embodiments of the lifting apparatus 10 described above, guiding elements 18 are provided in the form of mobile lift pulleys. The mobile lift pulleys move horizontally inward, from a first position, and/or outwards, from a second position, as the flexible divider lifts or lowers. The overall travel or displacement distance of the mobile lift pulleys can depend on the difference between the dimension of the profile/contour of the ceiling structure 16, and the required overall width of the flexible divider 12 (for example the contour of its bottom edge). The movement of the mobile lift pulleys can be either controlled or uncontrolled, and the ratio of fixed to mobile lift pulleys can change based on design, movement and other parameters. Moreover, each of the mobile lift pulleys can be configured to travel a different distance as the flexible divider 12 is raised. For example, a horizontal travel distance of outermost mobile lift pulleys (i.e. those closest to the ridge or ridges of the ceiling structure 16) can be greater than a travel distance of innermost mobile lift pulleys (i.e. those closest to the peak of the ceiling structure 16).

In a non-parallel ceiling to floor space, the ceiling's profile is longer than the width of the space at floor level that is to be divided. For example, an arch ceiling is a segment of a circle with an arc length (s) derived by:

$$s = \frac{\alpha}{180^\circ}\pi R = \theta R = \arcsin\left(\frac{c}{h + \frac{c^2}{4h}}\right)\left(h + \frac{c^2}{4h}\right)$$

Or, in the example of an equal-sided peak ceiling, it is the sum of (b)+(b).

$$b = \sqrt{h^2 + \frac{a^2}{4}}$$

The lifting apparatus 10 described above allows the mobile lift pulleys to move inwards, when the flexible divider 12 is lifted, so that the natural width of the designed flexible divider 12 rests along a narrower segment on the non-parallel ceiling structure 16 when stored in the raised configuration. Likewise, the mobile lift pulleys can return to their designed rest points, or first position, as the flexible divider 12 is lowered towards the floor or in the lowered configuration.

As can be appreciated, the described apparatus can allow full unobstructed use of the space, providing optimal clearance on non-parallel openings.

1—Actively Controlled Lifting Movement

FIGS. 1, 2, 7, 8, 9 and 10 show an example of an actively controlled lifting apparatus. In the present example the lifting apparatus is cable-controlled and comprises a control cable which is extended from a motorized winch at a rate to match the lifting and changing geometry of a flexible divider wall. The control cable retracts onto the motorized winch when lowering the flexible divider wall to return mobile lift pulleys, or guiding elements, to their designated rest point, also referred to in the present description as their "first position". It is appreciated that other control assemblies can be used, such as linear actuators (or ball screws and ball nuts) with matching movement speeds and limits, a motor driven trolley with mobile lift pulleys, a rack and pinion connected to mobile lift pulleys, among others.

More particularly, by way of example, and as illustrated in FIG. 3 and FIG. 4, it is possible to divide a space that has an arch-shaped ceiling structure with a radius of 163' with a flexible divider wall having a width of 198'-6" across the floor. If the arc length of the ceiling is 212', both ends of the flexible divider wall must move inwards 6'-9" in order to store in the lifted position along the arch profile of the ceiling.

In the illustrated configuration, the cable controlled lifting apparatus comprises:

- a superstructure, or guiding structure, attached to the ceiling structure to which a track is mounted;
- equally spaced cable guides, as shown in FIG. 10, attached to the superstructure;
- fixed lift pulleys attached to the superstructure;
- a motorized winch centrally mounted on the superstructure;
- nineteen panels with twenty lifting cables, each at a distance of 10'-3" plus edge for a total width of 198'-6";
- wherein two of the twenty lifting cables run through permanently fixed lift pulleys installed near the middle of the flexible divider wall on the superstructure that is mounted to the ceiling (the ratio of fixed to mobile lift pulleys may change based on the movement required);
- and wherein the remaining eighteen lifting cables, nine on each side of the flexible divider wall, run through mobile lift pulleys attached to trolleys running on a track curved to match the arch ceiling hung from the flexible divider wall superstructure which is mounted to the ceiling; and
- two control pulleys mounted at each end of the trolley/carrier track.

The flexible divider wall is 58'-3" high at the extremities and 90'-4" high at the peak. Referring to FIGS. 7, 8, 9 and 10 each of the lifting cables 77 are attached to the bottom of the flexible divider wall. The lifting cables run through rings/grommets 78 attached every 10' vertically up the flexible divider wall and run through a mobile lift pulley 72 except for two central lifting cables running through a fixed lift pulley 71 that is angled with a cable guide 70 toward the motorized winch.

Each of the mobile lift pulleys 72 is chained to the headband of the flexible divider wall. The headband is further supported every 18" with chains attached to carriers 74 running along the trolley track 80.

Two control cables 76 run outward from the motorized winch, one to each end of the flexible divider wall through the cable guides 70 and down from the fixed lift pulley 100, wraps around a control pulley 75 and attaches to the nearest mobile lift pulley 72.

The motorized winch can use yoyo pulleys that allow the cables to only wrap on top of themselves. Ten pairs of yoyo pulleys each have a different start diameter so that all cables completely lift the flexible divider wall to match the ceiling profile at the end of n revolutions. Each half of a pair is used to handle the corresponding cable on each side of the flexible divider wall. A reducer turns a second set of two yoyo pulleys or drum pulleys that let out 6'-9" of control cable in n/x revolutions, allowing the flexible divider wall extremities to ride up the trolley track as the divider lifts. As can be appreciated, in this configuration, the lifting cables and the control cables are driven by the same motorized winch. As can be further appreciated, although this example of a controlled lifting apparatus is shown for a ceiling structure and corresponding flexible divider having an arc shape, a similar configuration can be applied for other shapes as well.

2—Passively Controlled Lifting Movement

Figure 11:
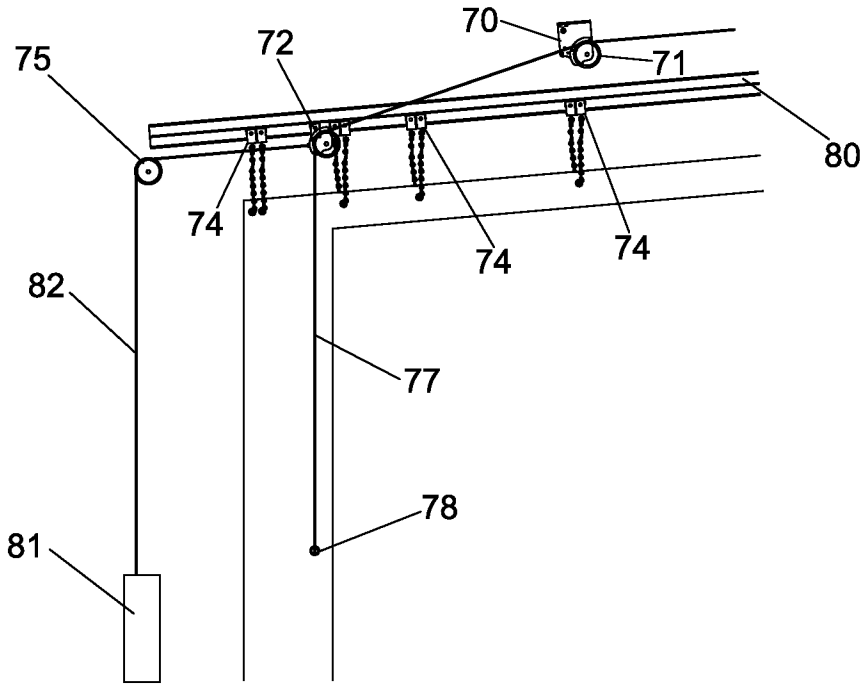
FIG. 11 is a front partial view of a lifting apparatus in accordance with an embodiment having passively-controlled guiding elements, where the guiding elements are urged toward a first position.
Figure 12:
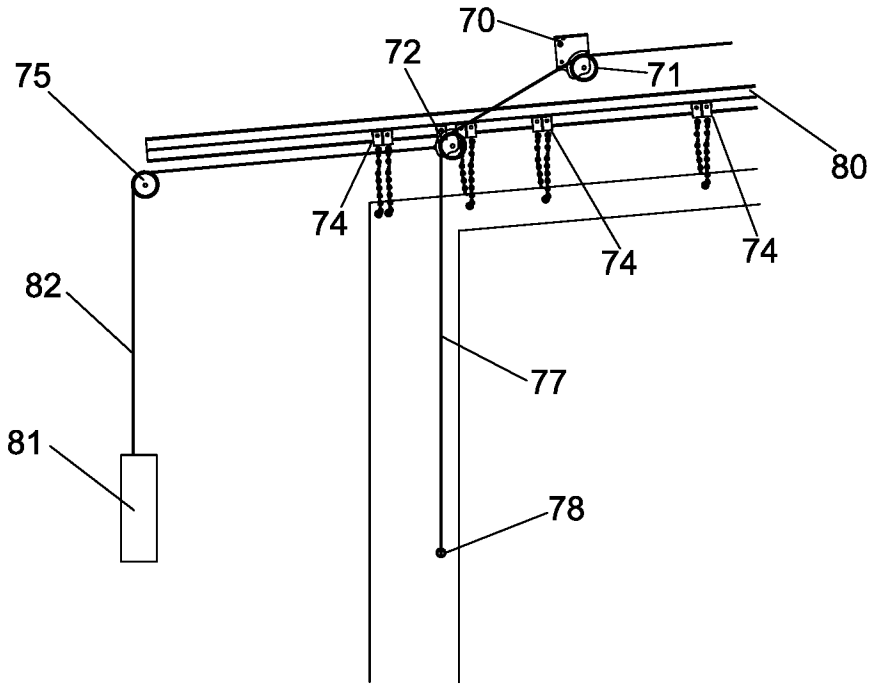
FIG. 12 is a front partial view of the lifting apparatus of FIG. 11, where the guiding elements are positioned between the first position and a second position.

FIGS. 11, 12 an 13 show an example of a passively controlled lifting apparatus. In summary, the mobile lift pulleys are not actively controlled by a cable and winch, but are instead biased via a passive biasing element, and the mobile pulleys move inward, toward a second position, as the flexible divider wall begins to raise. They only return to their rest point, or first position, when the flexible divider wall is fully lowered.

More particularly, by way of example and as shown in FIG. 5 and FIG. 6, it is possible to divide a peaked space with a slope of 14 degrees on both sides of the peak with a flexible divider wall having a width of 179'-8" across the floor. If the sum of the two slopes is 182'-4½", both ends of the flexible divider wall must move inwards 10" in order to be stored in the lifted position along the peak profile of the ceiling.

In the illustrated configuration, the passively controlled lifting apparatus comprises:

- a superstructure, or guiding structure, attached to the ceiling structure to which a track is mounted;
- equally spaced cable guides, as shown in FIG. 10, attached to the superstructure;
- fixed lift pulleys attached to the superstructure;
- a motorized winch centrally mounted on the superstructure;
- nineteen panels with twenty lifting cables, eighteen panels each having a width of 9'-5" and two panels each having a width of 9'-2" plus edge;
- wherein fourteen of the twenty lifting cables run through permanently fixed lift pulleys installed near the middle of the flexible divider wall on the superstructure that is mounted to the ceiling (the ratio of fixed to mobile lift pulleys may change based on the movement required);
- and wherein the remaining six lifting cables, three on each side of the flexible divider wall, run through mobile lift pulleys attached to trolleys running on a sloped track that is hung from the flexible divider wall superstructure, which is itself mounted to the ceiling; and
- two return pulleys mounted at each end of the trolley track.

Figure 13:
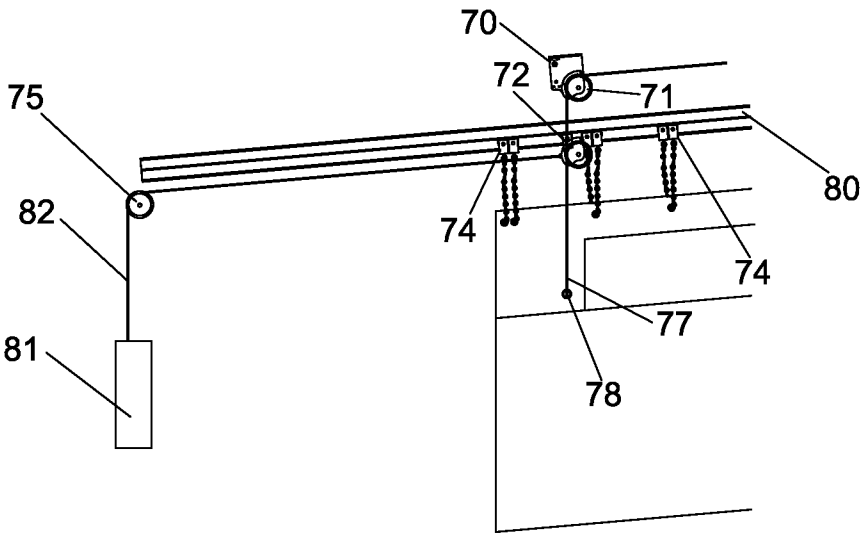
FIG. 13 is a front partial view of the lifting apparatus of FIG. 11, where the guiding elements are urged toward the second position.

Referring to FIGS. 11, 12 and 13, each of the lifting cables 77 is attached to the bottom of the flexible divider wall. The lifting cables run through rings/grommets 78 attached every 3' vertically up the flexible divider wall and run through a mobile lift pulley 72, except for the fixed central cables running through a fixed lift pulley 71 that is angled with a cable guide 70 toward the motorized winch.

Each of the mobile lift pulleys 72 is chained to the headband of the flexible divider wall. The headband is further supported every 18" with chains attached to carriers 74 running on the trolley track 80. The natural reaction of the mobile lift pulleys on trolleys 72 is to move inward toward a second position as the lifting cable 77 begins to lift. Full inward movement happens before the flexible divider wall lifts and the pulleys return to their rest points, or first positions, as the flexible divider wall is fully lowered.

A passive biasing element in the form of a tension spring 81 or exaggerated weight 81 connected 82 to the last mobile lift pulley 72 running through an end pulley 75 mounted on a track 80 can be used to restore the mobile lift pulleys 72 to their designated rest points, on lighter flexible divider wall units.

The invention claimed is:

1. A lifting apparatus for lifting a flexible divider in a space having a ceiling structure, the lifting apparatus comprising:

- a fixed pulley secured to the ceiling structure;
- a lifting cable supported by the ceiling structure, the lifting cable comprising a segment extending between the fixed pulley and a lift point on the flexible divider, said lifting cable being retractable in a vertical direction to lift the flexible divider from a lowered configuration to a raised configuration; and
- a guiding element for guiding a position of the segment of the lifting cable along a horizontal direction while the flexible divider moves between the lowered configuration and the raised configuration, said guiding element being movably mounted to the ceiling structure to move between a first horizontal position when the flexible divider is in the lowered configuration, and a second horizontal position when the flexible divider is in the raised configuration;

wherein in the first horizontal position, the guiding element is horizontally spaced apart from the fixed pulley, and in the second horizontal position the guiding element is substantially aligned with the fixed pulley along the vertical direction.

2. The lifting apparatus of claim 1, wherein the guiding element comprises a mobile pulley movable relative to the fixed pulley.

3. The lifting apparatus of claim 1, further comprising a pulling mechanism coupled to said lifting cable to pull on said lifting cable for retracting the lifting cable and lifting the flexible divider from the lowered configuration to the raised configuration.

4. The lifting apparatus of claim 3, wherein the lifting cable comprises a first end attached to the lift point of the flexible divider, and a second end cooperating with the pulling mechanism.

5. The lifting apparatus of claim 4, wherein the guiding element is positioned between the first and second ends of said lifting cable.

6. The lifting apparatus of claim 1, further comprising a guiding structure attached to the ceiling structure, wherein the guiding element is movably mounted to the guiding structure.

7. The lifting apparatus of claim 6, wherein the guiding structure has a shape conforming to a contour of at least a portion of the ceiling structure.

8. The lifting apparatus of claim 6, wherein the guiding structure comprises at least one track, and the guiding element is engaged in and moves along a path defined by the track.

9. The lifting apparatus of claim 1, further comprising a biasing device operatively coupled to the guiding element to control a displacement rate of the guiding element between the first and second horizontal positions as the flexible divider moves between the lowered and raised configurations.

10. The lifting apparatus of claim 9, wherein the biasing device is configured to apply a biasing force on the guiding element to oppose a force applied to the guiding element while the lifting cable is retracted.

11. The lifting apparatus of claim 9, wherein the biasing device comprises at least one selected from a group consisting of: a counterweight, a spring, and a motor.

12. The lifting apparatus of claim 11, further comprising a control cable having a first end secured to the guiding element and a second end operatively coupled to the biasing device, for operatively coupling the biasing device to the guiding element.

13. The lifting apparatus of claim 9, wherein the biasing device comprises an actuator or a motor configured to drive a movement of the guiding element in at least two opposite directions.

14. A lifting apparatus for lifting a flexible divider in a space having a ceiling structure, the lifting apparatus comprising:

a plurality of fixed pulleys supported by the ceiling structure;

a plurality of lifting cables supported by the ceiling structure, the plurality of lifting cables comprising segments extending between respective ones of the plurality of fixed pulleys and lift points spaced apart along a width of the flexible divider, the plurality of lifting cables being retractable in a vertical direction to lift the flexible divider from a lowered configuration to a raised configuration; and a plurality of guiding elements, each of the plurality of guiding elements being associated with a corresponding one of the plurality of lifting cables and its respective fixed pulley, each of said plurality of guiding elements being configured to guide the segment of its corresponding lifting cable along a horizontal direction while the flexible divider moves between the lowered configuration and the raised configuration, said plurality of guiding elements being movably mounted to the ceiling structure to move along corresponding horizontal travel distances when the flexible divider moves between the lowered configuration and the raised configuration;

wherein, while the flexible divider moves from the lowered configuration to the raised configuration, the plurality of guiding elements are configured to move towards respective horizontal positions that are vertically aligned with their associated fixed pulleys, and while the flexible divider moves from the raised configuration to the lowered configuration, the plurality of guiding elements are configured to move away from the respective horizontal positions that are vertically aligned with their associated fixed pulleys.

15. The lifting apparatus of claim 14, wherein a total horizontal travel distance of the guiding elements is adjusted according to a relative geometry of the flexible divider and the ceiling structure.

16. The lifting apparatus of claim 14, wherein a horizontal travel distance of an outermost guiding element is greater than a horizontal travel distance of an innermost guiding element.

17. The lifting apparatus of claim 14, further comprising a control cable having a first end secured to an outermost one of the guiding elements, and a second end operatively coupled to a biasing device.

18. The lifting apparatus of claim 17, wherein the biasing device comprises a motorized winch configured to retract the control cable.

19. The lifting apparatus of claim 18, wherein the plurality of lifting cables and the control cable are retracted by the same motorized winch.

20. A method of lifting a flexible divider in a space having a ceiling structure, the method comprising:

retracting a plurality of lifting cables in a vertical direction towards the ceiling structure to cause the flexible divider to be moved from a lowered configuration towards a raised configuration, wherein said lifting cables each comprise a segment extending between a corresponding one of a plurality of fixed pulleys secured to the ceiling structure and a corresponding one of a plurality of lift points on the flexible divider;

while the flexible divider is moving towards the raised configuration, displacing at least some of the plurality of lifting cables towards horizontal positions that are vertically aligned with their corresponding fixed pulleys; and while the flexible divider is moving towards the lowered configuration, displacing the at least some of the plurality of lifting cables away from the horizontal positions that are vertically aligned with their corresponding fixed pulleys.

21. A lifting apparatus for lifting a flexible divider in a space having a ceiling structure, the lifting apparatus comprising:

a lifting cable supported by the ceiling structure, the lifting cable extending along a vertical direction and attaching to a lift point on the flexible divider, said lifting cable being retractable in the vertical direction to lift the flexible divider from a lowered configuration to a raised configuration;

a guiding element for guiding a position of the lifting cable along a horizontal direction while the flexible divider moves between the lowered configuration and the raised configuration, said guiding element being movably mounted to the ceiling structure to move between a first horizontal position when the flexible divider is in the lowered configuration, and a second horizontal position when the flexible divider is in the raised configuration; and a control cable having a first end secured to the guiding element and a second end operatively coupled to a biasing device, for controlling a displacement of the guiding element between the first and second horizontal positions.

* * * * *